US006257495B1

(12) United States Patent
Eisenberg

(10) Patent No.: US 6,257,495 B1
(45) Date of Patent: Jul. 10, 2001

(54) DEVICE FOR SECURING RAILWAY RAILS ON STANDARD CONCRETE SLEEPERS IN A HIGHLY RESILIENT MANNER

(75) Inventor: Helmut Eisenberg, Werdohl (DE)

(73) Assignee: Vossloh Werke GmbH, Werdohl (DE)

( * ) Notice: Subject to any disclaimer, the term of this patent is extended or adjusted under 35 U.S.C. 154(b) by 0 days.

(21) Appl. No.: 09/125,879

(22) PCT Filed: Feb. 26, 1997

(86) PCT No.: PCT/EP97/00934

§ 371 Date: Nov. 30, 1998

§ 102(e) Date: Nov. 30, 1998

(87) PCT Pub. No.: WO97/32083

PCT Pub. Date: Sep. 4, 1997

(30) Foreign Application Priority Data

Feb. 27, 1996 (DE) ..... 196 07 339

(51) Int. Cl.[7] ..... E01B 9/00
(52) U.S. Cl. ..... 238/349
(58) Field of Search ..... 238/310, 315, 238/338, 342, 343, 349, 351, 352, 372

(56) References Cited

U.S. PATENT DOCUMENTS

| | | | | |
|---|---|---|---|---|
| 3,519,205 | * | 7/1970 | Monclin et al. | 238/310 |
| 4,066,212 | * | 1/1978 | Sonneville | 238/351 |
| 4,802,623 | * | 2/1989 | Fasterding et al. | 238/349 |
| 4,907,740 | * | 3/1990 | Oberweiler et al. | 238/310 |
| 5,096,119 | * | 3/1992 | Schultheiss et al. | 238/349 |
| 5,125,573 | * | 6/1992 | Vanotti | 238/351 |

FOREIGN PATENT DOCUMENTS

| | | |
|---|---|---|
| 126057 | 6/1977 | (DE) . |
| 0295685 | 12/1988 | (DE) . |
| 0377765 | 7/1990 | (DE) . |
| 3918091 | 12/1990 | (DE) . |
| 0455594 | 11/1991 | (DE) . |
| 4034032 | 4/1992 | (DE) . |
| 4212679 | 10/1993 | (DE) . |
| 0632164 | 6/1994 | (EP) . |
| 2715414 | 7/1995 | (FR) . |

* cited by examiner

*Primary Examiner*—Mark T. Le
(74) *Attorney, Agent, or Firm*—Sughrue, Mion, Zinn, Macpeak & Seas, PLLC

(57) ABSTRACT

A device for securing railway rails (12) on a solid track includes a standard concrete sleeper (16) used for the ballast track. Each of the rails (12) is guided between two angle guide plates (30) and urged by a tensible clamp (34) against the concrete sleeper (16). A resilient intermediate plate (52) is disposed between the rail flange (14) and the standard concrete sleeper (16) and, at their ends remote from the rail (12), the angle guide plates (30) include a first (24) and a second surface (28), the first surface (24) being inclined obliquely to the vertical in the mounted position and abutting a correspondingly shaped sloping surface (44) of the standard concrete sleeper (16). The second surface (28) is aligned substantially vertically and rises over the top of the standard concrete sleeper (16).

1 Claim, 1 Drawing Sheet

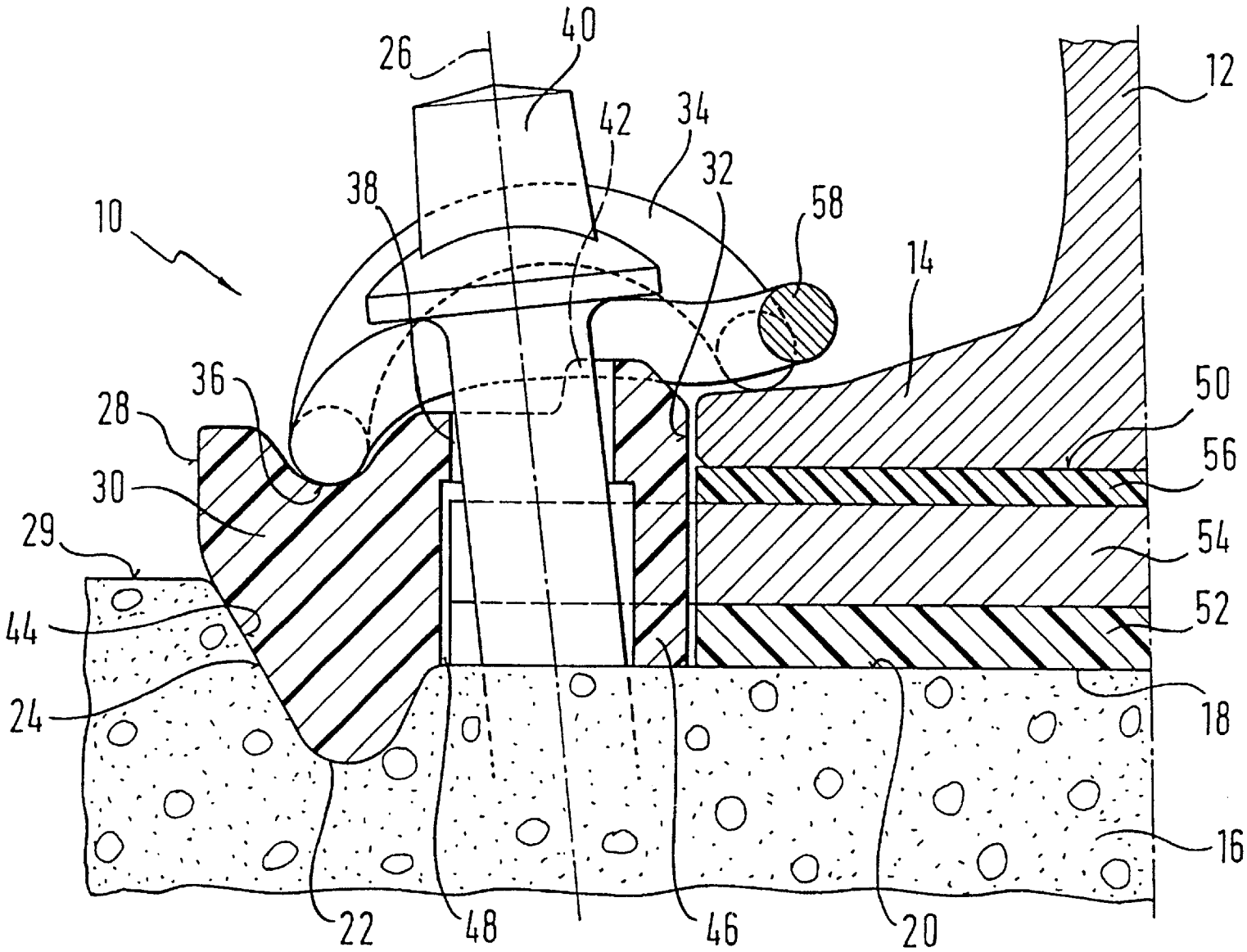
12
50
56
54
52
18
16
14
20
58
32
34
46
42
40
48
26
38
22
36
10
28
30
29
44
24

DEVICE FOR SECURING RAILWAY RAILS ON STANDARD CONCRETE SLEEPERS IN A HIGHLY RESILIENT MANNER

BACKGROUND OF THE INVENTION

The invention relates to a device for securing railroad rails on a ballast track or a solid track in a highly resilient manner.

Two separate systems exist as devices for securing railroad rails. On the one hand, the attachments for sleepers or supports on a ballast foundation, and on the other hand the superstructure for a solid track, i.e. securing rails for a superstructure without ballast. The superstructure on a solid track is increasingly gaining in important as axle loads and journey speeds rise, whereby as regards the superstructure on a solid track it is essential to achieve a requisite track compression.

Yet ballast tracks which are fitted with the standard superstructure also frequently exhibit rail compression values that are too low for use in high-speed transport on new routes. The resilience of ballast permits track compression which results in a rail head depression of about 0.6 mm. This track compression is clearly below today's desired rail head depression of 1.5 mm.

The resilient intermediate layers used in the prior art, even the use of so-called "soft" intermediate layers with static spring rates of c=50–70 kN/mm, improve track compression only to a rail head depression of about 1.0 mm (in conjunction with the ballast track).

A device for securing railroad rails on a solid track is described in EP 0 295 685. To achieve good track compression, a resilient intermediate plate is disposed between the rail flange and the concrete railroad sleeper; this plate ensures sufficient compression. Above the resilient intermediate plate there is located a pressure distribution plate which is dimensioned such that it and the resilient intermediate plate laterally project above the flange of the rail. Angle guide plates which form a support for tension clamps to secure the rails and which press the same against the rail flange by means of a sleeper screw are arranged on both sides of the rail flange. The guide angle plates form a rail channel, absorb the horizontal forces and introduce them into the concrete sleeper via angled surfaces in contact with the sleeper. The angle guide plates have chamber-like recesses into which the pressure distribution plate (protruding on both sides across the width of the rail flange) and resilient intermediate plate can project. The concrete sleepers described in EP 0 295 685 are specifically adapted to use on a solid track, and in the securing region they have a very low recess that completely receives the angle guide plates.

SUMMARY OF THE INVENTION

The present invention is based on the object of using standard elements and standard concrete sleepers to design a rail attachment, by means of which high rail compression values can be achieved.

The device for securing railroad rails on a ballast track or a solid track includes a standard concrete sleeper used on the ballast track; two angle guide plates for a securing point of the railroad track on the standard concrete sleeper, the plates being arranged on both sides of the rail flange for lateral guidance thereof; one securing screw per angle guide plate, the screw passing though the plate and pressing a tensible clamp against the rail flange and pressing the rail flange and the angle guide plate against the standard concrete sleeper; at least one resilient intermediate plate arranged between the rail flange and the standard concrete sleeper; wherein the angle guide plates have a first and a second surface at their end facing away from the rail, the first surface being inclined at an angle to the perpendicular in the mounted position and abutting a correspondingly shaped angled surface of the standard concrete sleeper, and the second surface being essentially vertically aligned and rising over the upper side of the standard concrete sleeper.

By using angle guide plates which can be inserted almost completely into the concrete sleeper's depression, not only a resilient intermediate plate but also a pressure distribution plate and a plastic intermediate layer can be arranged between rail and concrete sleeper despite the use of standard concrete sleepers, with it being possible nevertheless to use a standard tension clamp.

By providing the angle guide plates with receiving spaces which are each open toward the rail flange in the mounted position, the resilient intermediate plate can protrude on both sides across the width of the rail flange and project into the receiving spaces of the angle guide plates arranged on both sides of the rail.

Both the resilient intermediate plate and the pressure distribution plate advantageously have a larger extension in the standard concrete sleeper's longitudinal direction than the rail flange and therefore protrude across the width of the rail flange on both sides thereof and project into the receiving spaces of the angle guide plates. As a result, the pressure distribution plate distributes over a large surface area the forces transferred by the rail flange to this plate and introduces them evenly into the standard concrete sleeper via the resilient intermediate plate. This embodiment also enjoys the advantage that when the pre-assembled securing devices are delivered on the sleeper, the resilient intermediate plate and the pressure distribution plate are undetachably arranged between the two angle guide plates which form a securing point.

The securing screws are preferably anchored in interchangeable plastic screw dowels located in the standard concrete sleepers. This makes it possible on the one hand to perform quickly any necessary maintenance work that requires the screw dowel to be exchanged, and on the other hand to allow the use of various standard tension clamps and to adapt quickly and reliably the concrete sleeper to the particular sleeper screws used for this purpose.

According to a preferred embodiment, the shape of the angle guide plates is adapted to the use of a standard tension clamp for securing the rail flange, as described e.g. in DE 39 18 091. It is therefore possible to fall back on a maximum number of standard elements and perhaps to perform conversion of existing track installations without changing the tension clamps.

Different angle guide plates which in their mounted position have a varying horizontal extension in the standard concrete sleeper's longitudinal direction can be preferably used. As a result, the position of the rail channel formed between two angle guide plates is variably designed and the gauge can be set or corrected within predetermined limits.

The rotational axes of the securing screws are preferably inclined at an angle to the perpendicular. This makes it much easier to place the rail into the rail channel formed between the angle guide plates.

BRIEF DESCRIPTION OF THE DRAWING

The FIGURE shows a cross-section through a symmetrical device for securing a rail according to the present invention.

DETAILED DESCRIPTION OF THE PREFERRED EMBODIMENTS

The drawing shows a cross section through a symmetrical device 10 for securing a rail 12. The rail 12 together with a second rail 12 forms a railroad track. The device 10 serves to tension the flange 14 of the rail against a support 16 which in its longitudinal extension runs transverse to the longitudinal direction of the rail 12.

The support 16 preferably consists of concrete and represents for example a standard concrete sleeper, as used by the German railroad company Deutsche Bahn AG with the designation DB Standard Concrete Sleeper B70 W60. This standard concrete sleeper has so far been used in the ballast superstructure, but not on a solid track.

In the region in which one rail 12 of the rail pair is respectively received, the standard concrete sleeper 16, henceforth abbreviated to concrete sleeper, has a depression 18 that runs perpendicular to the longitudinal sleeper axis and is composed of a planar support surface 20 and groove-like depressions 22. The groove-like depressions pass in the longitudinal direction of the rail 12 and extend across the entire sleeper width or part thereof. The groove-like depression 22 has an angled surface 24 on the side that faces away from the rail 12.

A plastic dowel (60, see FIGURE), the longitudinal axis 26 of which is inclined with respect to the perpendicular in the mounted position, is also located in the concrete sleeper 16 for each securing device 10 in the region of the planar receiving surface 20. The angle to the perpendicular is about 5° in the illustrated exemplary embodiment.

An angle guide plate 30, which with the angle guide plate on the other side of the rail forms an exact rail channel, is respectively at the side of the rail flange 14 and is both supported on the planar receiving surface 20 and inserted into the groove-like depression 22. The angle guide plates also serve to remove horizontal forces and to receive a rail attachment that can be pre-assembled.

The angle guide plate 30 has a guide surface 32 for the rail flange 14; in its mounting position, this guide surface is preferably spaced a minimal distance away from the facing side of the rail flange 14. This makes it possible to obtain a rail head depression, as is required in the form of a predetermined rail compression value. The angle guide plate 30's side that is at the to in the mounting position and which faces toward a tension clamp 34 is adapted to the shape and function of the particular tension clamp 34 used. In the present example, the angle guide plate has a guide channel 36 for receiving a rear support curve of the tension clamp 34, a bore 38 for a sleeper screw 40 and a guide channel 42 for the inner shank of the tension clamp 34. On the side facing the concrete sleeper 16 in the mounted position, the angle guide plate 30 is shaped to correspond to the concrete sleeper. The angled surface 44 of the angle guide plate 30 is shaped such that contact is made as completely as possible with the angled surface 24 of the concrete sleeper and hence any horizontal forces that arise can be removed as evenly as possible into the concrete sleeper. Support elements 46 are formed in the region of the concrete sleeper's planar receiving surface 20; the vertical forces which arise during tightening of the tension clamp 34 are transferred to the concrete sleeper 16 by these elements.

The angle guide plate 30 has, toward the rail 12, a U-shaped profile parallel to the longitudinal rail axis when viewed in vertical section and whose shanks are formed by the support elements 46. As a result, a chamber-like receiving space 48 is obtained between the planar receiving surface 20 of the concrete sleeper and the transverse element of the U-shaped profile on the one hand and between the two support elements 46 on the other. This receiving space serves to accommodate the following elements arranged between the underside 50 of the rail 12 and the planar receiving surface 20.

An essentially vertical, outer terminating surface 28 that projects above the upper side 29 of the concrete sleeper 16 beyond the depression 18 adjoins the angled surface 44 at that end of the angle guide plate 30 which points away from the rail 12. As shown in the drawing, surface 28 has a linear aspect forming an angle with a linear aspect of surface 44.

To achieve a required rail head depression both in the case of a solid track and on a ballast track, the resilience of which permits a rail head depression of only about 0.6 mm, a resilient intermediate plate 52 is placed on the concrete sleeper's planar receiving surface 20 and hence is placed between the rail's underside 50 and the concrete sleeper. The resilient intermediate plate 52 is composed of an elastomer and has a static spring rate that is adjustable in accordance with requirements.

A pressure distribution plate 54 which is planar and can be easily produced in rolled steel is placed over the resilient intermediate plate 52. The pressure distribution plate 54 and the resilient intermediate plate 52 have an extension in the concrete sleeper's longitudinal direction that is larger than the width of the rail 12 at the underside 50 thereof. As a result, the pressure distribution plate 54 and the resilient intermediate plate 52 each laterally project over the flange 14 of the rail.

The resilient intermediate plate 52 and pressure distribution plate 54 protrude into the chamber-like receiving spaces 48 of the angle guide plates 30 arranged on both sides of the rail and are each provided with a slot oriented in the longitudinal sleeper axis. The resilient intermediate plate 52 and pressure distribution plate 54 preferably make form-locked contact with the receiving space 48's longitudinal walls that run in the longitudinal direction of the concrete sleeper. The clearance of the receiving space 48 is dimensioned to be larger than the total thickness of resilient intermediate plate 52 and pressure distribution plate 54, thus essentially preventing the end sections of the plates 52 and 54 from pressing together when the angle guide plates 30 are pressed down onto the concrete sleeper 16. The force applied by the tension clamp 34 is essentially transferred directly to the concrete sleeper 16 via the angle guide plate, which causes the rail's angle of inclination to keep to the required accuracy even if the two tension clamps of a securing point are perhaps unevenly pre-tensioned.

The highly resilient intermediate plate 52 allows the rail to exhibit the necessary vertical depression and can be selected such that the rail's desired compression is achieved. The steel pressure distribution plate 54 evenly distributes over a large surface area those vertical forces which act upon the rail. The pressure distribution plate 54 therefore acts as an artificial enlargement of the rail flange.

A plastic intermediate layer 56 is also disposed between pressure distribution plate 54 and the underside 50 of the rail 12.

Various tension clamps 34 and sleeper screws 40 known in the prior art can be used in the device 10 for securing railroad rails on a ballast track or on a solid track. In the present example, the rail is tensioned with the resilient tension clamp SKL 14 common in the ballast superstructure. The two free spring arms 58 of the tension clamp 34 are supported on the rail flange. A center loop that prevents tilting also projects over the rail flange. The rail is vertically tensioned by tightening the sleeper screw 40 anchored in interchangeable plastic screw dowels. After tightening the tension screw 40, the two free spring arms 58 of the tension clamp 34 exert a force of about 2×10 kN on the rail in the case of a resilient spring path of approx. 13 mm.

The rail attachment can be pre-mounted on the sleeper and then delivered. For this purpose, the tension clamps are in a pre-assembly position which is shown in the aforementioned DE 39 18 091 for the SKL 14 tension clamp depicted in the drawing. The sleeper screw 40 is screwed into the plastic dowels only by a few turns and enables the tension clamp 34 to be pre-mounted by being shifted to the left with respect to the mounting position shown in the drawing, i.e. it is moved away from the site where the rail is subsequently fitted only. To do so, the tension clamp 34 is no longer located in the guide channel 36 of the angle guide plate 30.

The tension clamp 34 and the angle guide plate 30 on the one hand, as well as the resilient intermediate plate 52 and the pressure distribution plate 54 on the concrete sleeper 16 on the other are fixed into the mounting position via the sleeper screw 40. When mounting the rails, only the plastic intermediate layer 56 has to be interposed between the underside 50 of the rail 12 and the pressure distribution plate 54, the tension clamp 34 shifted in the rail flange's direction so that the free spring arms 58 are supported on the rail flange 14, and the sleeper screw 40 finally tightened.

In the mounted state, the angle guide plates 30 arranged on both sides of the rail 12 form a rail channel, and remove the horizontal forces into the concrete sleeper 16 via the contact of the angled surfaces 44 and 24. Part of the horizontal forces that arise are also introduced into the concrete sleeper by the axes 26—inclined at an angle to the perpendicular—of the sleeper screws 40.

The securing system 10 is designed to make height regulation possible up to 5 mm without tamping work. If desired, gauge regulation of up to ±10 mm can also be performed by using specially shaped angle guide plates 30 whose interaction on both sides of the rail 12 systematically shifts the rail channel in the longitudinal direction of the concrete sleeper 16.

Since the resilient intermediate plate 52 permits the required high rail compression in the form of a predetermined rail head depression of about 1.5 mm, the described rail attachment is also suitable for the use of high-speed trains on new routes. It is therefore possible to convert an existing ballast track to the securing system according to the invention by continuing to use standard concrete sleepers, which also makes this system suitable for use in high speed transport.

It is also possible to fill up the cavities of the ballast track with concrete, asphalt of the like and therefore to continue using this securing system on a solid track without changing the system because the manner of securing rails according to the invention achieves the desired high compression values as regards overall resilience even without the ballast foundation's contribution.

What is claimed is:

1. A device for securing railroad rails on one of a ballast track and a solid track in a highly resilient manner, comprising:

a standard concrete sleeper used for said ballast track;

two angle guide plates for securing one railroad rail of said rails on said standard concrete sleeper, said plates being arranged on both sides of a rail flange for lateral guidance thereof;

one securing screw per angle guide plate, said screw passing through said plate and pressing a tensible clamp against said rail flange and pressing said rail flange and said angle guide plate against said standard concrete sleepers;

at least one resilient intermediate plate arranged between said rail flange and said standard concrete sleeper;

wherein said angle guide plates have a first and a second surface an at end facing away from said rail, said first surface being inclined at an angle to a perpendicular in a mounted position of said angle guide plates and abutting a correspondingly shaped angled surface of said standard concrete sleeper, and said second surface being essentially vertically aligned and rising over an upper side of said standard concrete sleeper, said first surface having a linear aspect forming an angle with a linear aspect of said second surface;

wherein said angle guide plates have receiving spaces which are each open toward said rail flange in the mounted position of said angle guide plates;

wherein said at least one resilient intermediate plate has a larger extension in a longitudinal direction of said standard concrete sleeper than said rail flange and protrudes beyond a width of said rail flange on both sides and projects into said receiving spaces of said angle guide plates;

wherein a pressure distribution plate is arranged between said rail flange and said standard concrete sleeper, said pressure distribution plate having a larger extension in a longitudinal direction of said standard concrete sleeper than said rail flange and protruding beyond a width of said rail flange on both sides thereof and projecting into said receiving spaces of said angle guide plates; and wherein rotational axes of said securing screws are inclined at an angle to the perpendicular.

* * * * *